US005508116A

United States Patent [19]

Barrett

[11] Patent Number: 5,508,116

[45] Date of Patent: Apr. 16, 1996

[54] METAL MATRIX COMPOSITE REINFORCED WITH SHAPE MEMORY ALLOY

[75] Inventor: David J. Barrett, Erdenheim, Pa.

[73] Assignee: The United States of America as represented by the Secretary of the Navy, Washington, D.C.

[21] Appl. No.: 431,917

[22] Filed: Apr. 28, 1995

[51] Int. Cl.[6] ..... B22F 7/00; C22K 1/00

[52] U.S. Cl. ..... 428/567; 428/548; 75/229; 75/249; 419/5; 419/32; 419/48; 419/67

[58] Field of Search ..... 419/5, 32, 48, 419/67; 428/548, 567; 75/229, 249

[56] References Cited

U.S. PATENT DOCUMENTS

| | | | |
|---|---|---|---|
| 4,310,354 | 1/1982 | Fountain et al. | 419/31 |
| 4,554,027 | 11/1985 | Tautzenberger et al. | 148/11.50 R |
| 4,657,822 | 4/1987 | Goldstein | 428/552 |
| 4,722,825 | 2/1988 | Goldstein | 419/8 |
| 5,100,736 | 3/1992 | London et al. | 428/549 |
| 5,145,506 | 9/1992 | Goldstein et al. | 75/240 |

*Primary Examiner*—Donald P. Walsh
*Assistant Examiner*—Scott T. Bluni
*Attorney, Agent, or Firm*—Susan E. Verona

[57] ABSTRACT

A metal matrix composite reinforced with shape memory alloy is disclosed which is formed by blending metal particles and shape memory alloy particles to form a homogeneous powder blend, and consolidating the powder blend to form a unitary mass. The unitary mass is then plastically deformed such as by extrusion in the presence of heat so as to cause an elongation thereof, whereby the metal particles form a matrix and the shape memory alloy partices align in the direction of elongation of the unitary mass. The composite can be used in structural applications and will exhibit shape memory characteristics.

10 Claims, No Drawings

METAL MATRIX COMPOSITE REINFORCED WITH SHAPE MEMORY ALLOY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to metal matrix composites, and more particularly to the use of shape memory alloys in metal matrix composites, and to a method of making such composites which employs powder metallurgical techniques.

Shape memory alloys are alloys which undergo temperature-dependent and/or load-dependent phase transformations from one solid phase to another solid phase. For instance, at a temperature below the alloy's transition temperature range, the solid phase is martensitic. Above the transition temperature range the alloy typically is in a body-centered cubic solid phase known as austenite. Such an alloy can be formed into a desired shape when in the austenitic phase and then heat-treated to remember that shape. If the alloy is subsequently deformed while in the martensitic state, it will regain the desired shape upon being heated to a temperature at which it becomes austenite.

Because of their ability to return to an original desired shape, shape memory alloys have been a major element of the smart materials and smart structures research and development effort. Many designs specify the monolithic application of these materials. However, some applications call for the embedding of shape memory alloys within structural components, in order, for example, to sense environmental changes and to control structural and mechanical responses. Currently, shape memory alloy wires are embedded in structural materials to meet these needs. This method of embedding shape-memory alloys into structural components is labor intensive and expensive. Furthermore, it would be desirable to provide a structural component which has a more uniform distribution of shape-memory properties throughout it than these components have.

Shape memory alloys have been processed using powder metallurgical techniques. For instance, powders of different shape memory alloys have been blended to form an alloy which has a transition temperature range somewhere between those of the individual powders. Shape memory alloy powders have also been blended with metal carbide powders to form a composite with the shape memory alloy forming the matrix and the metal carbide particles being dispersed throughout the matrix. There does not currently exist, however, a metal matrix composite suitable for structural applications which has a uniform distribution throughout its matrix of shape memory alloy particles.

SUMMARY OF THE INVENTION

Accordingly, it is a general object of the present invention to provide a structural material which possesses shape memory characteristics.

It is a more specific object of the present invention to provide a method of producing a metal matrix composite reinforced with aligned shape memory alloy particles.

It is another object of the present invention to provide a method of making a structural material which possesses shape memory characteristics.

Briefly, these and other objects of the present invention are accomplished by a composite having shape memory properties, comprising particles of a shape-memory alloy uniformly dispersed throughout and bonded to a metal matrix material. The composite is formed by blending particles of the metal and the shape memory alloy, and then plastically deforming the powder blend at an elevated temperature which is below the annealing temperature of the shape memory alloy. The majority of the particles of shape memory alloy have an aspect ratio greater than 3, and they have their major axes aligned in one direction.

Other objects, advantages, and novel features of the invention will become apparent from the following detailed description of the invention.

DETAILED DESCRIPTION OF THE PREFERRED EMBODIMENT

The present invention provides a composite having a metal matrix reinforced with particles of a shape memory alloy uniformly distributed throughout the metal matrix. The composite is formed from a consolidated powder blend by extrusion or other hot-working process accompanied by large plastic deformation or strain and concomitant elongation of the consolidated powder blend. The shape memory alloy particles, which have an aspect ratio of at least 3, align with their major axes in the direction of elongation during the extrusion or other deformation process. The composite comprises from about 10 volume percent to about 20 volume percent shape memory alloy. Much less than 10 volume percent shape memory alloy will not provide enough of the alloy to impart shape memory characteristics to the composite. The upper volume percentage is limited by the fact that it is desirable to have each shape memory alloy particle completely bonded around its entire surface to matrix material. Too much shape memory alloy causes adjacent particles to contact each other during the plastic deformation process.

The composite of the invention can be deformed while in the martensitic state, and return to its original shape upon making the transition to the austenitic state. For example, the composite can be deformed, such as by elongating it, and a structural part can then be made from it. The part can operate below the transition temperature range of the shape memory alloy in essentially the same manner as could a part made of just the matrix material. If, in the course of use, the part made from the composite is heated to a temperature at which the matrix material will soften but which is above the transition temperature range of the shape memory alloy, the shape memory particles will try to return to their original shapes by contracting. In so doing they will try to pull along with them the surrounding matrix material to which they are bonded, thereby providing greater overall stiffness and strength to the composite than the matrix material alone would have at that temperature. Such a composite may be made in the following manner.

Particles of material for the matrix are provided. The matrix material may be any metal, the needs of the application dictating the selection. The choice of metal is governed in large part by the same criteria as would be used for selecting the metal for use by itself. For example, aluminum, particularly alloys in the 2000 and 6000 series (Aluminum Association designation) makes an appropriate metal matrix for lightweight structural applications.

The metal matrix material of choice is then reduced to powder. Any powder metallurgical technique known to those skilled in the art may be used. Standard powder metallurgical procedures may be performed on the powder which are normally recommended for the metal powder of choice, such as vacuum degassing it to remove moisture, or pulverizing it to reduce particle size. The metal powder's particle size should be small enough to coat the particles of shape memory alloy. For example, particles that are 80/+325 mesh (ASTM std B214-76) are effective.

Any shape memory alloy can be used in the composite of the invention, the selection depending on the desired transition temperature for the composite, which may depend on its ultimate application. Nickel-titanium shape memory alloys are particularly desirable for use in the composite of the invention because they will exert a large recovery force on the surrounding matrix when attempting to return to their original shape during transition to the austenitic phase. Nickel-titanium shape memory alloys generally comprise at least 45 weight percent nickel and at least 30 weight percent titanium. One suitable NiTi alloy is 49.5 atomic percent Ni (54.56 weight percent Ni). A prealloyed NiTi powder can be formed by melt spinning the alloy to form ribbon, which is then comminuted into powder having a mesh size of, for example, –40.

The aspect ratio of the particles of shape memory alloy in the composite should be at least 3, but most desirably greater than 30, because longer particles will impart a larger recovery stress, which will load the surrounding metal matrix more. A –40 mesh powder of shape memory alloy can be further mechanically worked, such as by hammering, to increase the aspect ratio.

The metal powder and the shape memory alloy powder are then combined in the desired proportion (about 10 to about 20 volume percent shape memory alloy) to form a powder blend. The combined powders are then mixed until they are uniformly blended. This may be achieved by tumbling the powders in a rotating cylinder or V-cone blender for one hour. The blend should be vacuum-degassed to drive off moisture and minimize the formation of pockets of gas in the composite.

The powder blend is then prepared for further processing by either canning it or compacting it into a unitary mass for ease of handling. If the powder is canned, the vacuum-degassing step may be performed by evacuating the can, as known by those skilled in the art. Alternatively, the blend may be vacuum hot-pressed, during which the degassing of the powder blend occurs. The compacting parameters such as temperature and pressure are dictated by the metal matrix material with the proviso that the temperature not exceed the shape memory alloy's annealing temperature, which in the case of nickel-titanium shape memory alloys is about 600° C. Of course, the powder blend could be cold-compacted in combination with either canning plus evacuation or vacuum hot-pressing.

The unitary mass is then hot-worked, or plastically deformed, in the presence of heat. When the unitary mass is thus deformed the metal particles bond to form a continuous matrix. The hot-working temperature for the composite will be within the recommended hot-working temperature range for the matrix material but should not exceed the annealing temperature of the shape memory alloy. Extrusion is a preferred means of plastic deformation and causes the shape memory alloy particles to align parallel to the extrusion direction. The reduction ratio of the extrusion process should be as high as is practical, but at least about 20 to 1. The greater the reduction ratio is, the more shear is imparted to the shape memory alloy particles. A high reduction ratio combined with a high aspect ratio is believed to encourage elongation of the shape memory alloy particles during the extrusion process. Any extrusion process may be used, including direct, indirect, and hydrostatic processes. The extrusion die may be either conical or right-angle, the right-angle type providing greater shear forces. Any die shape may be used as well.

A specific example of an embodiment of the invention follows.

EXAMPLE

Ingots of the shape memory alloy were prepared from high-purity elemental nickel and titanium. In order to insure alloy homogeneity, the shape memory alloy ingots were arc-melted in argon, turned, and re-melted three times. The NiTi was then melt spun using a 0.254-m diameter molybdenum wheel rotating at 2400 rpm (25 m/s) to form NiTi ribbon having the composition Ni-50.5 at.% Ti (54.56 wt. % Ni). The NiTi ribbon was comminuted into powder using a hammer mill. The powders were then screened to –40 mesh.

Inert-gas-atomized aluminum alloy 2219 (Aluminum Association designation) powder was screened to –80/+325 mesh. A blend of 20-volume-percent NiTi and 80-volume-percent 2219 aluminum was prepared using a V-cone mixer.

The powder blend was sealed in a fully annealed 2024 aluminum can. The canned powder was then vacuum-degassed at 300° C. for one hour. The canned powder was then hot-extruded on a 200-ton extrusion press at 300° C. using an extrusion die with a 45° angle and an area reduction of 20 to 1. As the composite was extruded through the 45°-angle die, the shape memory alloy powder oriented itself in the extrusion direction, i.e., the long axes of the powder particles tended to align in the longitudinal direction of the extrusion.

Following extrusion, the 2024 can material was removed and the extrudate was sectioned into 100-mm long by 10-mm diameter test bars. The bars were solution heat-treated and aged in order to produce the T6 temper in the 2219 aluminum matrix: solution heat treated at 535° C. for 0.75 hours, cold water-quenched, naturally aged at room temperature for 96 hours, and artificially aged at 190° C. for 37.5 hours. Tensile bars were machined having a 6-mm diameter by 60-mm long reduced cross-section.

The tensile property test results for the composite and for a 2219 aluminum control specimen processed from powder in the same manner as the composite are shown in the TABLE. Also shown are the predicted values for the composite based on the rule of mixtures. The differences between the predicted and measured values of yield strength and modulus are modest: 6.8% and 6.4%, respectively. This indicates that in the elastic portion of the stress-strain curve the composite behaved as predicted.

TABLE

| PROPERTY | 2219 AL | COMPOSITE (MEASURED) | COMPOSITE (PREDICTED) |
|---|---|---|---|
| UTS | 383 MPa | 260 MPa | 394 MPa |
| YS | 234 MPa | 221 MPa | 207 MPa |
| Modulus | 6.79 GPa | 57.4 GPa | 61.3 GPa |
| % RA | 14.7 | 1.0 | — |
| % Elong | 14 | 4 | — |

Some of the many advantages and novel features of the present invention should now be readily apparent. For instance, a composite has been provided that exhibits shape memory characteristics. Such a composite could, for example, be used in structural applications, and when deformed, such as by being elongated in the direction of the alignment of the shape memory alloy particles, would return to its original shape upon experiencing a temperature- or load-induced phase transition. Furthermore, a method of making such a structural composite has been provided.

Other embodiments and modifications of the present invention may readily come to those of ordinary skill in the art having the benefit of the teachings of the foregoing description. Therefore, it is to be understood that the present invention is not to be limited to the teachings presented and that such further embodiments and modifications are intended to be included in the scope of the appended claims.

What is claimed is:

1. A composite having shape memory properties, comprising particles of a shape-memory alloy uniformly dispersed throughout and bonded to a metal matrix material, said composite being formed by plastic deformation at an elevated temperature which is below the annealing temperature of the shape memory alloy, the majority of said particles of shape memory alloy having an aspect ratio greater than 3, and said particles having their major axes aligned in one direction.

2. The composite of claim 1, wherein the metal matrix material is an aluminum alloy.

3. The composite of claim 2, wherein the metal matrix material is an aluminum alloy in the group consisting of the 2000 series and the 6000 series of aluminum alloys.

4. The composite of claim 1, wherein the shape memory alloy is a nickel-titanium alloy.

5. The composite of claim 4, wherein the shape memory alloy comprises at least 45 weight percent nickel and at least 30 weight percent titanium.

6. The composite of claim 1, wherein the aspect ratio of the particles of shape memory alloy is greater than 30.

7. The composite of claim 1, wherein said composite comprises from about 10% to about 20% by volume shape memory alloy.

8. The composite of claim 1, wherein said composite is formed by extrusion, and said particles of shape memory alloy are aligned in the direction of the extrusion.

9. A composite having shape memory properties, formed by the steps of:

providing metal particles;

providing prealloyed particles of a shape memory alloy, the particles having an aspect ratio greater than 3:

blending the metal particles and the particles of the shape memory alloy to form a homogeneous powder blend;

consolidating the powder blend to form a unitary mass: and plastically deforming the unitary mass at an elevated temperature which is below the annealing temperature of the shape memory alloy and at a reduction ratio of at least about 20 to 1 so as to cause an elongation of the unitary mass, whereby the metal particles form a matrix and the shape memory alloy particles are uniformly dispersed throughout the metal matrix and have their major axes aligned in the direction of elongation of the unitary mass.

10. A composite having shape memory properties, formed by the steps of:

blending aluminum alloy particles and shape memory alloy particles to form a homogeneous powder blend comprising from about 10 to about 20 volume percent shape memory alloy:

consolidating the powder blend to form a unitary mass: and extruding the unitary mass at an elevated temperature which is below the annealing temperature of the shape memory alloy and at a reduction ratio of at least about 20 to 1. whereby the aluminum alloy particles form a matrix and the shape memory alloy particles are uniformly dispersed throughout the aluminum alloy matrix and aligned in the direction of extrusion.

* * * * *